United States Patent [19]

Lessig, III et al.

[11] 4,305,176

[45] Dec. 15, 1981

[54] AIR-POWERED VACUUM CLEANER FLOOR TOOL

[75] Inventors: William R. Lessig, III, Cockeysville; Danny R. Jinkins, Bel Air, both of Md.

[73] Assignee: Black & Decker Inc., Newark, Del.

[21] Appl. No.: 72,080

[22] Filed: Sep. 4, 1979

[51] Int. Cl.[3] ..... A47L 5/30

[52] U.S. Cl. ..... 15/325; 15/183; 15/377; 15/387; 15/392; 15/410

[58] Field of Search ..... 15/325, 351, 377, 378, 15/387, 389, 392, 410, 422, 183

[56] References Cited

U.S. PATENT DOCUMENTS

| | | | |
|---|---|---|---|
| 2,101,575 | 12/1937 | Dow . | |
| 2,314,081 | 3/1943 | Dow et al. | 15/387 |
| 2,659,098 | 11/1953 | Meyerhoefer | 15/325 X |
| 2,668,979 | 2/1954 | MacFarland | 15/392 X |
| 2,683,276 | 7/1954 | Olsen | 15/387 |
| 2,734,220 | 2/1956 | Tschudy | 15/410 |
| 2,962,748 | 12/1960 | Magarian | 15/387 |
| 2,963,270 | 12/1960 | Magarian | 253/40 |
| 3,005,224 | 10/1961 | Magarian | 15/392 X |
| 3,071,799 | 1/1963 | Jepson et al. | 15/354 |
| 3,120,021 | 2/1964 | Pauler et al. | 15/377 |
| 3,225,374 | 12/1965 | Daley et al. | 15/183 |
| 3,325,849 | 6/1967 | Waters | 15/392 |
| 3,354,496 | 11/1967 | Jonsson | 15/377 |
| 3,688,339 | 9/1972 | Vincent et al. | 15/392 X |
| 3,815,170 | 6/1974 | Brooks et al. | 15/377 X |
| 4,167,801 | 9/1979 | Erbor et al. | 15/377 X |

FOREIGN PATENT DOCUMENTS

| | | | |
|---|---|---|---|
| 223232 | 8/1959 | Australia | 15/387 |

*Primary Examiner*—Chris K. Moore

*Attorney, Agent, or Firm*—Harold Weinstein; Walter Ottesen; Edward D. Murphy

[57] ABSTRACT

A vacuum cleaner floor tool is provided which comprises a housing formed by upper and lower members which mate with one another along a single plane inclined with respect to the base plane or bottom of the lower member. An air-powered turbine motor is positioned in the housing and includes a turbine chamber for the turbine motor, and a rotary floor agitator is provided which partially extends from the housing. The agitator is coupled to the turbine motor and is driven thereby. A base plate is removably mounted on the housing and forms a portion of a wall thereof, with the agitator extending from the housing through an opening in the base plate. Air passes through the opening in the base plate into the turbine chamber. The base plate includes a ramp which extends from the base plate into the housing, where the ramp and a portion of the turbine chamber form a nozzle for the turbine motor.

52 Claims, 26 Drawing Figures

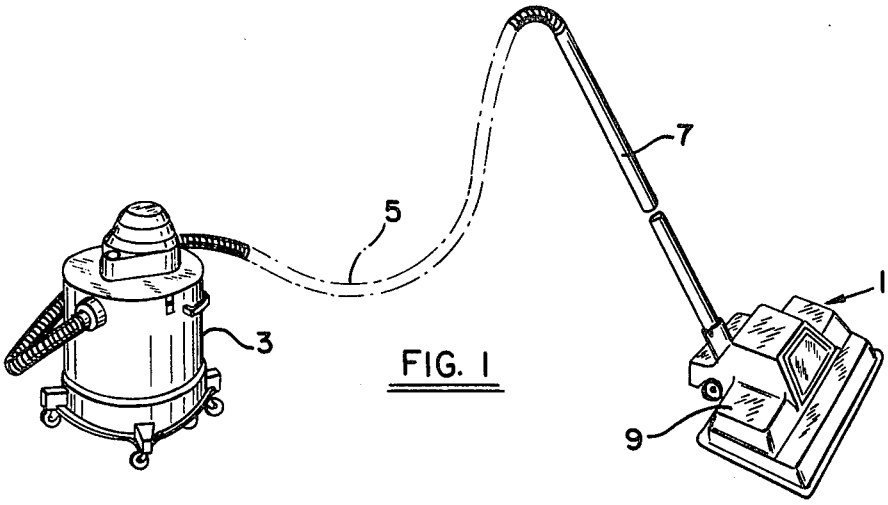
FIG. 1
FIG. 2
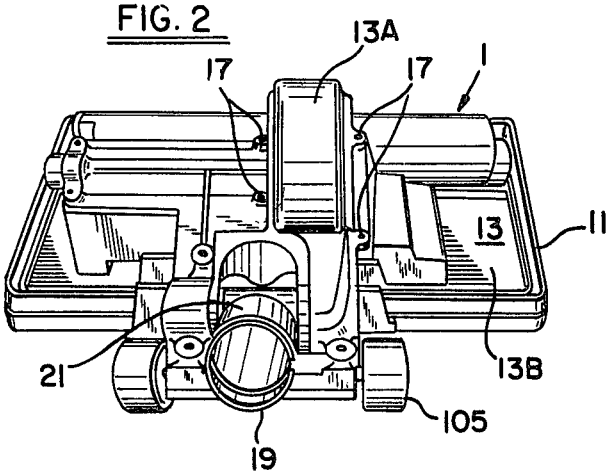
FIG. 3
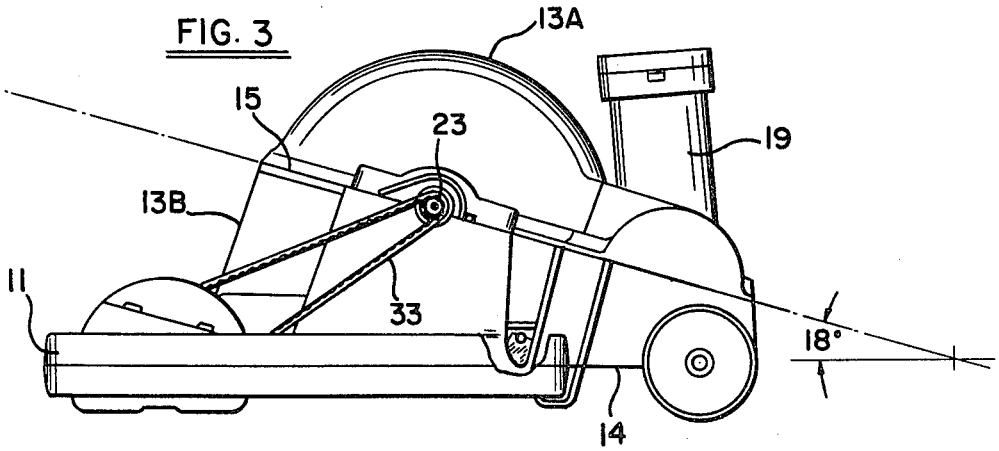

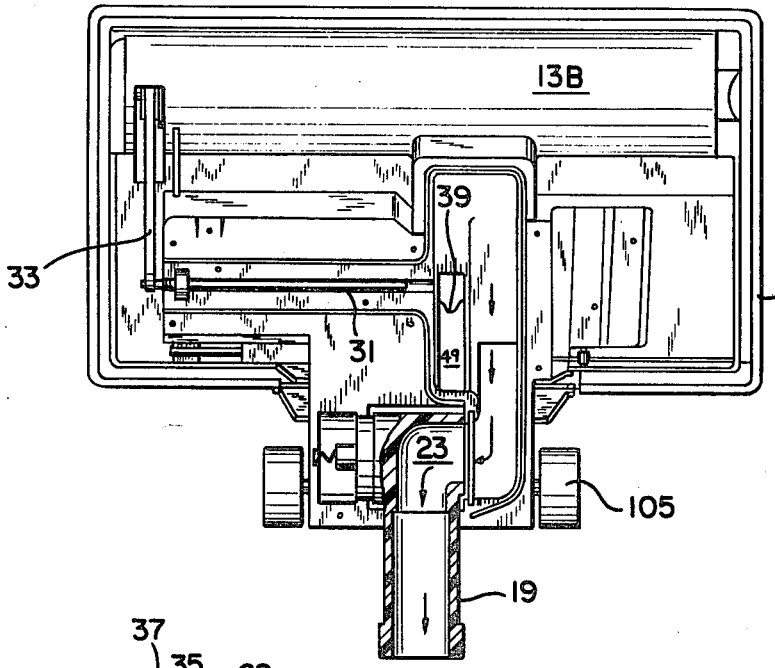
FIG. 4B
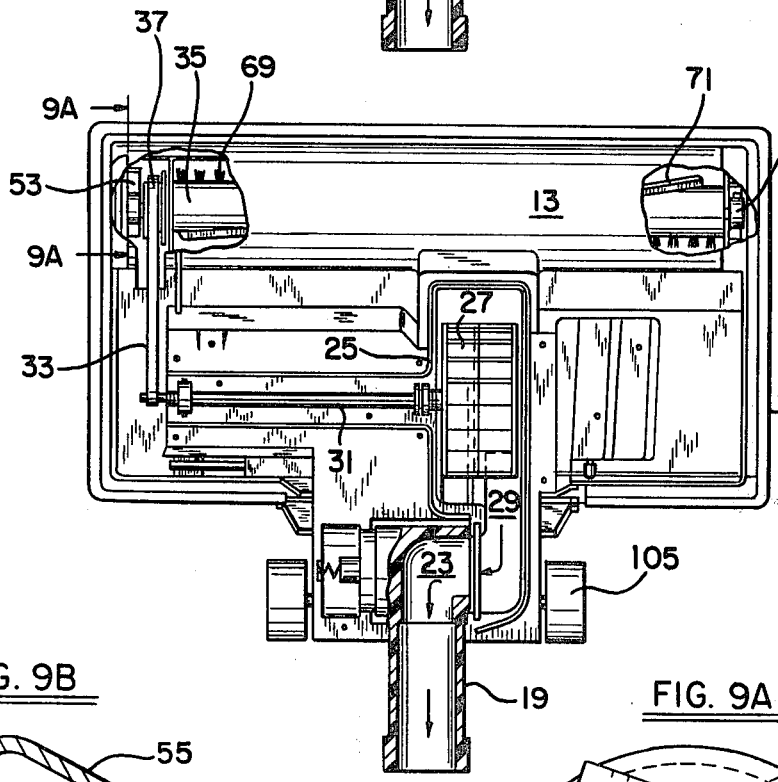
FIG. 4A
FIG. 9B
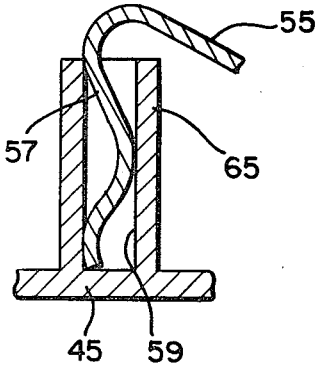
FIG. 9A
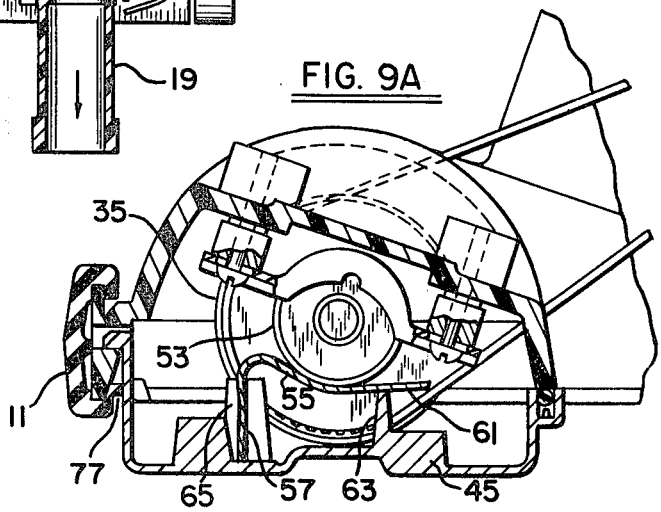

AIR-POWERED VACUUM CLEANER FLOOR TOOL

BACKGROUND OF THE INVENTION

1. Field of the Invention

This invention is related to a vacuum cleaner floor tool and, more particularly, a vacuum cleaner floor tool which has a turbine driven agitator wherein the floor tool has a clam-shell housing formed by two members which mate along a single plane and which has a removable base plate including a ramp which forms the nozzle for the turbine motor.

2. Description of the Prior Art

Vacuum cleaner floor tools having air-powered turbine motors for driving agitators are known in the prior art. Typical examples of these can be found among the following U.S. patents:

U.S. Pat. No. 2,683,276
U.S. Pat. No. 2,962,748
U.S. Pat. No. 2,963,270
U.S. Pat. No. 3,005,224
U.S. Pat. No. 3,071,799
U.S. Pat. No. 3,354,496

All of these patents, however, suffer from various disadvantages. In Magarian U.S. Pat. No. 3,005,224, for example, the ramp which forms the nozzle to the air-powered turbine motor is a separate element from the base plate and, therefore, suffers from problems of alignment, difficult removal, etc. Furthermore, these patents do not disclose manually removable base plates to provide access to the interior of the turbine motor. Typically, these patents have screw-mounted base plates which require the use of a screwdriver for their removal and, in some instances, such as Magarian '224 noted above, have a small access hole in the base plate. The small access hole is not, however, adequate for the removal of many of the objects which may become lodged in the nozzle or turbine motor. Because of the small size of the hole, access is very limited.

Split clam-shell type housings have also been used in vacuum cleaner floor tools as, for example, in some of the patents cited above. However, these housings are not split along a single plane which is inclined with respect to the base or bottom of the lower housing member. The split housings of the prior art wherein the split is formed along more than one plane present difficulties in sealing the two housing members together, which is necessary in order to prevent leakage through the mating surfaces. In order to provide adequate sealing in the prior art, it is necessary that the pieces be formed with close tolerances and structurally complicated sealing means must be provided.

Elbow-type couplings for vacuum cleaner wands and hoses are also known in prior art vacuum cleaner floor tools as, for example, those shown in the following U.S. patents:

U.S. Pat. No. 2,101,575
U.S. Pat. No. 2,314,081
U.S. Pat. No. 2,734,220
U.S. Pat. No. 3,071,799

Some of the above patents disclose latching mechanisms which allow the extension portion of the elbow which connects to a vacuum cleaner wand to be placed in a fixed position such as a vertical storage position, and in a rotatable position such as that during the use of the vacuum cleaner. The latch mechanisms are, however, complicated, requiring a foot pedal, various nuts and bolts and structurally complicated parts.

The agitators in prior art vacuum cleaner floor tools are driven by either air-powered or electric motors within the floor tools. These agitators are coupled to the motors by various types of drive belts. Generally, a pulley connector is connected to the agitator by means of a press or friction fit, or by a special flat surface formed on the agitator. These structures require either separate manufacturing steps or, as in the specially formed surfaces, are subject to wear and slippage such as in the press or friction fitted connectors.

SUMMARY OF THE INVENTION

It is a primary object of the present invention to provide an air-powered turbine motor driven vacuum cleaner floor tool which has a removable base plate with a smooth ramp integrally formed thereon. The face of the ramp forms one of the walls of the nozzle for the turbine motor. The removability of the base enables the user to gain access to the interior of the nozzle and turbine motor to remove objects which may become lodged therein.

It is another primary object of the present invention to provide a housing formed by upper and lower members which mate along a single plane which is inclined with respect to the plane of the base, or bottom, of the lower housing member. The mating of the upper and lower members along a single plane eliminates problems of alignment and close tolerances where housing members are fitted together in more than one plane. Furthermore, the single plane eliminates sealing problems which result from trying to seal along multiple planes. The inclining of the mating plane enables the axis of rotation of a vacuum cleaner wand or hose to be positioned relatively low on the floor tool, thereby eliminating tipping and providing stability in operation. The axis of rotation of the turbine is, however, higher, thereby allowing for the use of a larger diameter turbine.

It is a still further object of the present invention to provide a vacuum cleaner floor tool which has a manually operated retaining device for holding the base plate on the housing. The retaining device holds the base plate in place during operation, but is manually operable so that an operator may unlock or release the base plate and then remove it to gain access to the nozzle or turbine motor to remove an object therefrom. The manually operable aspect of the retaining device eliminates the requirement for a tool, such as a screw driver, for releasing the base plate.

It is still another object of the present invention to provide a vacuum cleaner floor tool which has a bumper strip surrounding the floor tool where the bumper strip includes a lip, which extends from the strip and contacts the housing to form an air seal with the base plate. This eliminates air losses resulting from leakage of air drawn from above the base plate.

It is still a further object of the present invention to provide a vacuum cleaner floor tool in which a rotary agitator is coupled to, and driven by, a turbine motor. The connector is fitted onto a portion of the agitator which is formed using existing agitator structure.

It is still another object of the present invention to provide a vacuum cleaner floor tool which has a bumper strip therearound, and which has a cover which covers the floor tool housing. The cover has a notch which engages the bumper strip and holds the bumper strip in place. The notch in the cover is a simple, effective holding structure.

It is still another object of the present invention to provide a vacuum cleaner floor tool which has an elbow latch for latching the elbow coupling which couples the floor tool to a vacuum cleaner wand or hose. The latch structure is simple to manufacture, requiring only a stamped metal plate and a spring. The structure does not require screws, rivets, etc.

It is still a further object of the present invention to provide a vacuum cleaner floor tool which includes a support for the rotary agitator where the support is simple and does not require screws, rivets, etc. and does not require close tolerances.

The present invention is directed to a vacuum cleaner floor tool which comprises a housing having a first and second corresponding member which are mated together in a single plane to form the housing. An air-powered turbine motor is positioned in the housing, the housing forming the turbine chamber for the turbine motor. A rotary agitator partially extends from the housing, with the agitator being coupled to the turbine motor and driven thereby. Coupling means are mounted in the housing for coupling the turbine chamber to a vacuum cleaner, and a removable base plate is mounted on the housing and forms a portion of a wall thereof. The agitator extends from the housing, through an opening in the base plate and air passes through the opening into the turbine chamber. The base plate includes a ramp extending from the base plate into the housing. The ramp and a portion of the turbine chamber form the nozzle for the turbine motor. The single plane in which the first and second housing members are mated is formed by the axis of the turbine motor and the axis of the coupling, this plane forming an acute angle with the plate through the bottom of the base wall of the second housing member.

The inclusion of the ramp as part of the base plate and the removability of the base plate enables a user to gain access to the interior of the nozzle and turbine motor by simply removing the base of the vacuum cleaner floor tool in order to remove objects which may become lodged therein. Thus, the present invention provides easy access to the turbine for the removal of objects. Furthermore, the ramp is made continuous, thereby increasing the efficiency of air flow therethrough and thus enhancing the efficiency of the turbine motor. In addition, since the ramp is made as an integral part of the base plate, alignment problems are eliminated and the ramp can be made thick and strong, thereby eliminating problems resulting from wear or impacting by objects drawn into the turbine motor.

The formation of the housing by upper and lower members which mate along a single plane enable the upper and lower members to be mated together without forming these members with very close tolerances, as would be required in devices which mate in multiple planes. Furthermore, sealing is simplified because sealing is only required in a single plane. The inclination of the mating plane with respect to the plane of the base of the lower member of the housing enables the axis of the coupling to the vacuum cleaner to be positioned relatively low, while the axis of the turbine motor is positioned relatively high. The low axis of the coupling motor will enable the wand or hose of a vacuum cleaner to be connected to the floor tool at a low point, which will prevent tipping and provide stability when the floor tool is pushed along a floor being cleaned. The relatively high axis of the turbine motor enables a relatively large diameter turbine to be used, thereby enhancing the torque of the motor and thus the cleaning efficiency of the floor tool.

Another feature of the present invention is the provision of a bumper strip which surrounds the housing, the bumper strip having a lip which contacts the housing to form an air seal. Since the air seal is formed by a lip on the bumper strip itself, this lip can be formed during the manufacture of the bumper strip and, thus, it is easy to manufacture and can be produced at substantially no additional cost.

Still another feature of the present invention is the manually operable base plate retaining device or latch which securely holds the base plate in position during operation, but which is simple to operate and does not require tools to enable the user to unlatch and remove the base plate in order to gain access to the interior of the nozzle and turbine motor to remove objects therefrom. The base plate retaining device is easy to operate, requires no tools, has a minimum number of parts, exerts a large holding force on the base plate and accommodates a wide range of tolerances. The device can be operated with one hand, and is independent of the base plate and can be moved out of the way in order to provide access to the interior of the housing. Furthermore, the base plate is inclined at the point of contact in order to concentrate the force of the retaining device in the center of the base plate.

Still a further feature of the present invention is the coupling used to couple the rotary agitator to the turbine motor. The rotary agitator has spiral grooves which have agitating devices such as brushes or beater bars mounted therein. The diameter of one of the ends of the rotary agitator is reduced or turned down so that a reduced diameter is formed such that the bottom of the spiral grooves forms substantially flat surfaces on the reduced diameter. A connector is fitted over the reduced diameter portion and the connector has lugs which engage the flat surfaces, thereby preventing relative rotation between the connector and the rotary agitator. The connector is connected to the turbine motor by means of a belt. Since the flat surfaces are formed from spiral grooves which are already in the agitator, the coupling is simple and inexpensive. Also, since the flat surfaces are formed on a relatively large diameter, this coupling provides a good mechanical advantage.

Still another advantage of the present invention is a cover which covers the floor tool housing. The cover has a notch therein which engages the bumper strip surrounding the housing and holds the bumper strip in place.

Still a further feature of the present invention is a latch for holding a vacuum cleaner wand or hose, coupled to the floor tool, in a fixed vertical position for storage and in rotatable position when the floor tool is in use. The floor tool has a rotatable elbow coupling with an extension portion and a cylindrical rotating portion. The cylindrical portion has a protrusion which extends therefrom, and the latch mechanism includes a latch plate having a protrusion which is opposed to the protrusion on the cylindrical portion of the elbow. The protrusion on the latch plate is biased towards the protrusion on the elbow coupling by means of a spring. This structure requires a minimum number of parts, which are simple to manufacture. The latch plate is made by stamping, for example, and the protrusion on the elbow can be made by molding during the molding of the elbow itself, and thus requires no additional manufacturing. The latch plate is hinged to the housing using a pinless pivot arrangement, and the protrusion on the latch plate can be made wide and stiff, thereby eliminating the possibility of breaking or damage.

Still a further feature of the present invention is the support structure for the rotary agitator. The base plate is formed with a slot and stud aligned with one another along a line perpendicular to the axis of the agitator. A substantially L-shaped strip of spring metal is formed with one end portion of the strip being engaged in the slot and the other end portion resting on the stud. The portion of the strip between the slot and the stud supports the agitator. This structure is very simple and requires no screws, rivets, etc. to hold the structure in place. Furthermore, the metal has no tab which can break. The support structure is easy to replace and does not require close tolerances.

BRIEF DESCRIPTION OF THE DRAWINGS

FIG. 1 is a perspective view of a vacuum cleaner connected to a floor tool of the present invention;

FIG. 2 is a perspective view of a floor tool of the preferred embodiment of the present invention with the cover removed;

FIG. 3 is an elevational view of the preferred embodiment of the present invention;

FIGS. 4A and 4B are top views of the preferred embodiment of the present invention, with the upper housing member removed;

FIG. 9A is an elevational view of an agitator support structure of the preferred embodiment of the present invention;

FIG. 9B is an enlarged partial section of FIG. 9A;

DETAILED DESCRIPTION OF THE PREFERRED EMBODIMENTS

Figure 6:
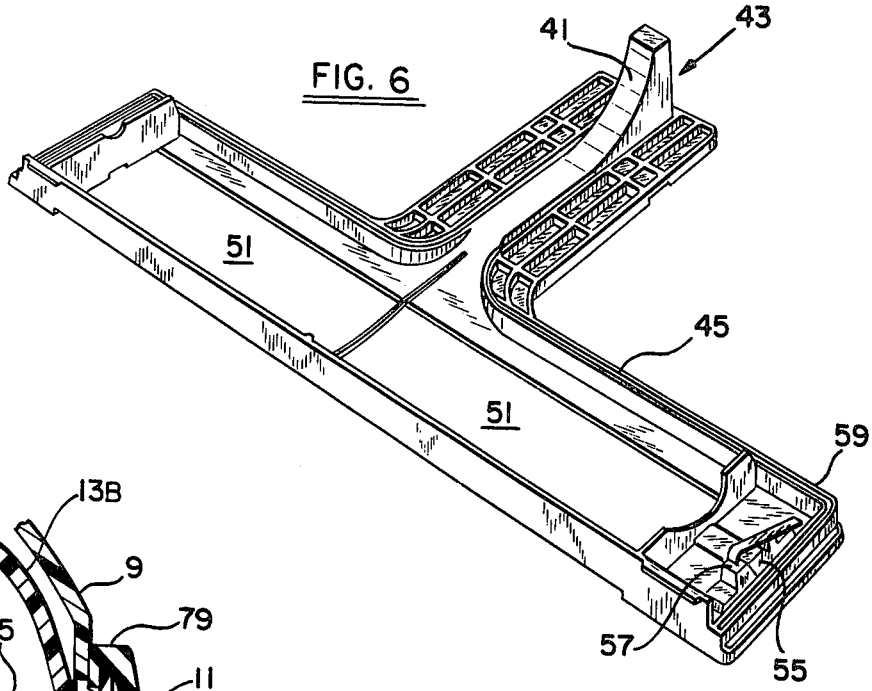
FIG. 6 is a perspective view of a base plate of the preferred embodiment of the present invention.

FIG. 1 illustrates a floor tool 1 of the present invention which is connected to a vacuum cleaner 3 by means of a hose 5 and a wand 7. The floor tool 1 of the present invention can be used with any type of vacuum cleaner, and the cannister-type cleaner 3 illustrated in FIG. 1 is merely by way of example. The floor tool 1 has a cover 9 which covers the upper portion thereof.

FIGS. 2 and 3 illustrate the floor tool with the cover 9 removed therefrom. A bumper strip 11 surrounds the housing 13 which has an upper member **13*a* and a lower member 13*b*. The members 13*a* and 13*b* mate wih one another along a planar surface 15, the upper and lower members being held together by means of bolts or screws fitted into the holes 17**. This type of construction, wherein the housing is formed of an upper and a lower member, is referred to as a "clam shell" type of housing.

The surface 15 is inclined with respect to the plane of the base, or bottom 14 of the lower member **13*b*. The angle of inclination is preferably 18°. The angle of inclination of the surface 15 is significant because it permits the extension portion 19 of an elbow 21 to enter the housing 13 at a point below the axis 23 of a turbine motor which is within the housing, while simultaneously allowing the surface 15 to pass through the axis of the turbine motor. By positioning the axis of the elbow 21 on the surface 15 and below the axis 23, the operation of the floor tool is facilitated because, when an operator pushes the floor tool using the wand 7, the force is applied to a lower portion of the housing, thereby preventing a tipping of the housing over its forward end. Furthermore, since the axis 23 of the turbine motor must lie in the plane of surface 15, the inclination raises the height of the axis 23, thereby permitting the use of a larger size turbine which will, of course, result in greater motor torque and thereby enhance the efficiency of the vacuum cleaner floor tool. Also, since both axes, i.e, the axis of the coupling elbow 21 and the turbine motor axis 23**, lie in the same plane, which is the plane between the upper and lower members of the housing, the present invention eliminates the necessity for a stepped surface between the upper and lower members of the housing which would create sealing and tolerance problems.

FIG. 4A shows the floor tool of the present invention with the upper member of the housing 13A removed. The turbine motor 25 includes a rotor 27 which is positioned in a turbine chamber 29 formed by the upper and lower housing members **13*a* and 13*b*. Shaft 31, which lies on axis 23 of the turbine rotor, rotates with the turbine rotor and a drive belt 33 couples the shaft to a rotary agitator 35 through a pulley or connector 37**.

Referring to FIGS. 4–8, the nozzle of the air-powered turbine motor 25 is formed by the walls 39 of the housing member **13*b* and the face 41 of ramp 43, which is integrally formed on base plate 45. The base plate 45 is removably positioned on the bottom of lower housing 13*b* and, in FIG. 7, the dashed lines illustrate the base plate 45 in its partially withdrawn position and the solid lines illustrate it in its normally closed position. The nozzle for the turbine motor is shown at 47. Referring to FIG. 4B, which corresponds to FIG. 4A with the turbine rotor removed, the ramp 43 extends into the opening 49 in the housing member 13*b* to form the nozzle 47, along with the face 41 of the ramp 43. The base plate 45 has a large opening 51 with the rotary brush agitator 35 partially extended through the opening 51. In operation the air for the turbine motor 25 is drawn through the opening 51 and through the nozzle 47 formed by the ramp 41 and the walls 39 of the housing 13*b* into the turbine motor 25. A pressure differential is created across the turbine motor by coupling the elbow extension 19 to a vacuum cleaner, as illustrated in FIG. 1. The rotation of the turbine rotor 25 is transmitted to the rotary agitator 35 by means of shaft 31, belt 33 and connector 37** to rotate the brush which agitates carpeting, for example, to enhance the removal of dirt therefrom by means of the vacuum cleaner.

Referring to FIGS. 4A, 5A and 10–12, the agitator 35 has therein a plurality of spiral grooves 67 which have therein either brushes 69 or beater bars 71. The brushes 69 or beater bars 71 agitate the carpeting to loosen dirt therein as the rotary agitator is rotated by the turbine motor. The end portion 73 of the rotary agitator 35 is reduced or turned down to a diameter in which the spiral grooves 67 are substantially flat surfaces 67*a*. The connector 37 is mounted on the reduced diameter end portion 73 of the rotary agitator 35. The connector 37 has lugs (not shown) which mate with the flat surfaces 67*a*, thereby preventing relative rotation between the connector 37 and the rotary agitator 35. The drive belt 33 drives the connector 37 which, in turn, drives the rotary agitator 35. The lugs 75 and flat surfaces 67*a* cooperate to prevent slippage.

Figure 5B:
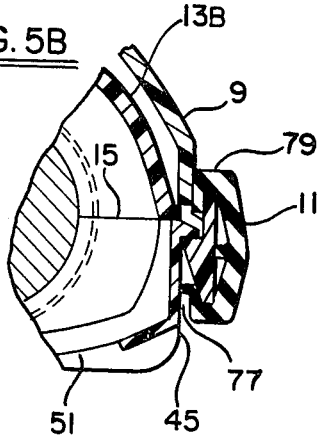
FIG. 5B is an enlarged partial section of FIG. 5A.
Figure 5A:
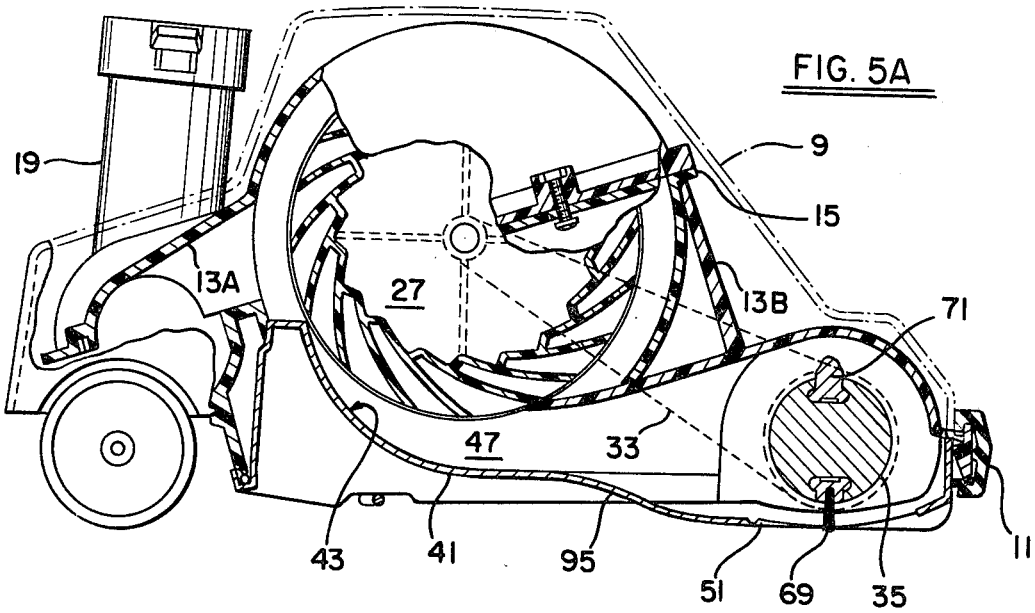
FIG. 5A is an elevational view of the invention, partially in section.
Figure 7:
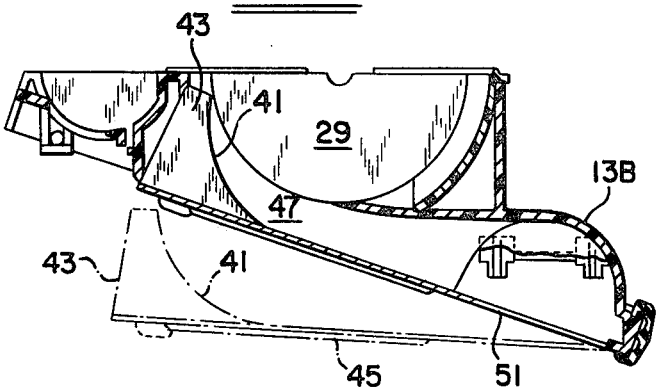
FIG. 7 is a sectional view of the base plate of the preferred embodiment of the present invention, mounted on the floor tool housing.
Figure 8:
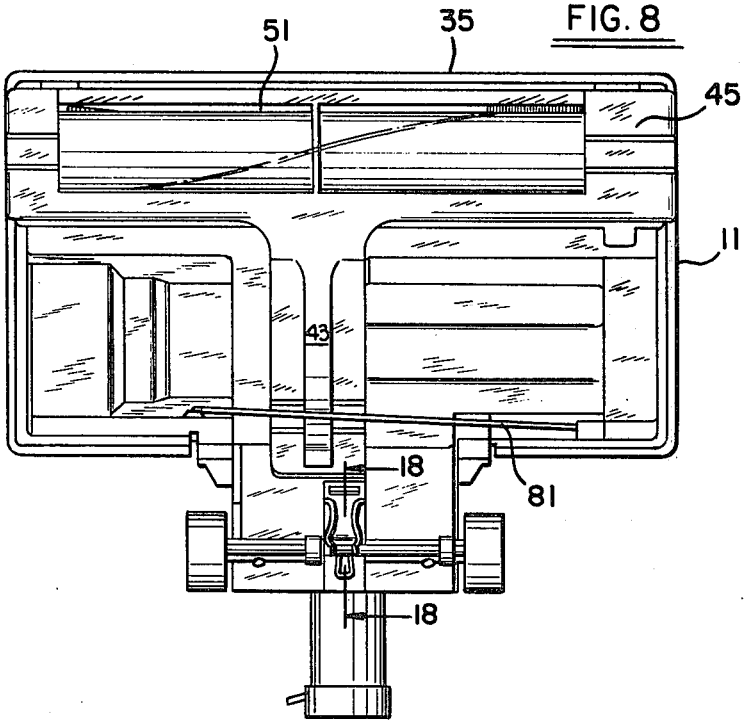
FIG. 8 is a bottom view of a vacuum cleaner floor tool of the preferred embodiment of the present invention.
Figure 10:
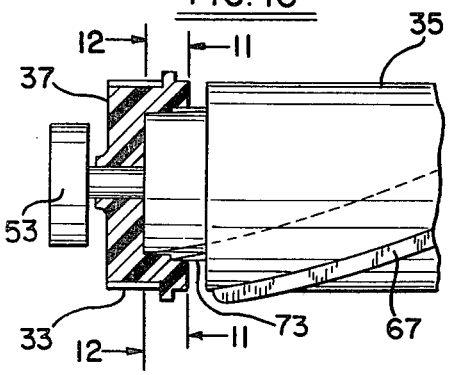
FIGS. 10–12 illustrate the preferred embodiment of the agitator drive coupling of the present invention.
Figure 11:
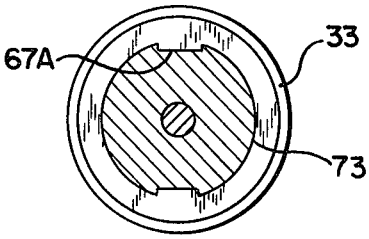
Figure 12:
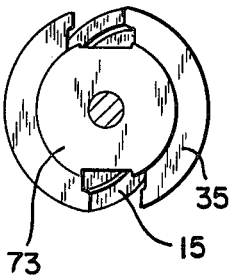

Referring to FIGS. 5A, 5B and 6, air is drawn into the housing 13 through the opening 51 in the base plate 45. In order to optimize the cleaning efficiency of the vacuum cleaner floor tool, all of the air should be drawn through the opening 51. In order to eliminate passage of air through the surface between the lower housing member 13*b* and the base plate 45, the bumper strip 11 has a small lip or extension 77 which forms an air seal with the base plate 45. This lip is integrally formed as part of the bumper strip. The top portion 79 of the bumper strip 11 forms a seal with the housing cover 9 which acts to prevent dislodging of the bumper along its perimeter.

Figure 13A:
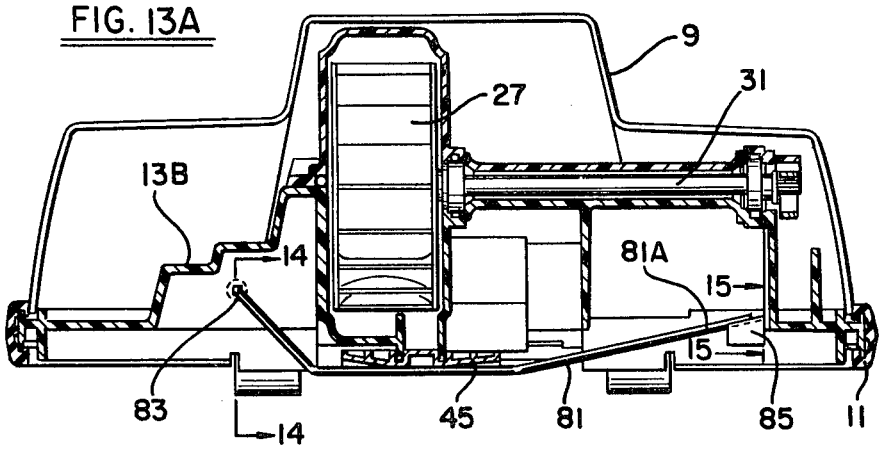
FIGS. 13A, 13B, 14 and 15 illustrate the preferred embodiment of the base plate retaining device of the present invention.
Figure 13B:
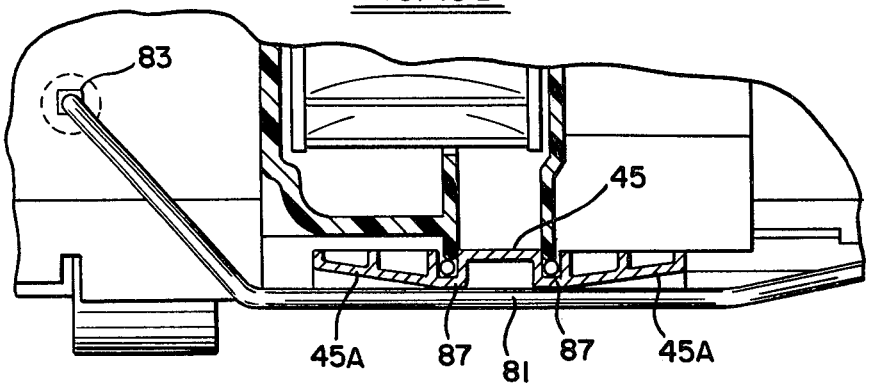
Figure 14:
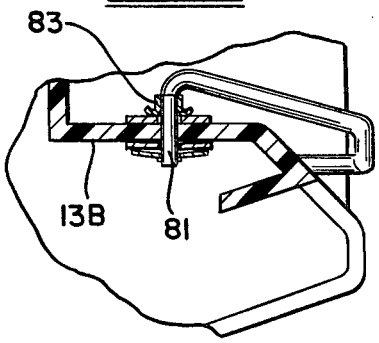
Figure 15:
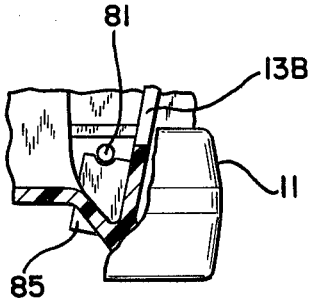

Referring to FIGS. 13–15, the removable base plate 45 is held in place by a retaining rod 81. The rod 81 is pivotally mounted in the lower housing member 13*b* at 83. The outer end 81*a* of the retaining rod 81 engages a projection 85 which may be integrally formed in the lower housing member 13*b*. The base plate 45 has inclined portions 45*a* so that the retaining rod 81 engages and holds the base plate at points 87 near the longitudinal center of the base plate. This provides an even distribution of force by the retaining rod to hold the base plate in place.

When it is desired to remove the base plate 45 in order to remove an object which may have become lodged in the turbine chamber, the end 81*a* of the retaining rod 81 is manually lifted from the projection 85 and pivoted about point 83. This results in the disengagement of the retaining rod 81 from the base plate 45, and the positioning of the rod 81 in a non-obstructing position. The base plate 45 may then be lifted out of the housing 13, thereby exposing the interior of the turbine chamber.

Referring to FIGS. 6 and 9, the ends of the rotary agitator 35 have bearings 53 which are supported by springs 55. The springs 55 have ends 57 which are inserted into slots 59 formed in a boss 65 of the base plate 45, while the other ends 61 are supported on studs 63 formed on the base plate 45. The springs 55 are held in slots 59 by means of the bent end portions 57.

Figure 16:
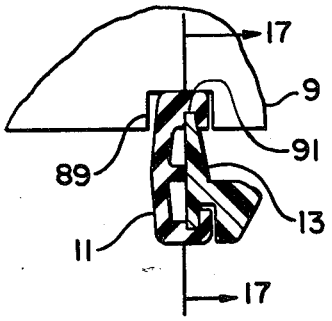
FIGS. 16 and 17 illustrate the preferred embodiment of the bumper strip retaining structure of the present invention.
Figure 17:
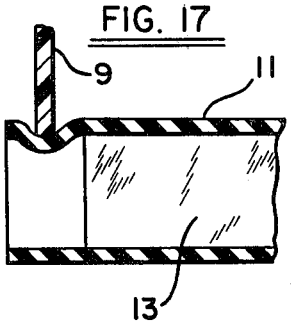

Referring to FIGS. 16 and 17, the bumper strip 11 is held in place by means of a notch 89 in the rear portion of the cover 9. When the cover is placed over the housing 13, the notch engages the upper portion of the bumper strip 11 and holds it against the edge 91 of the housing 13. This prevents the bumper strip from separating from the housing and holds it in place on the housing 13.

Figure 20:
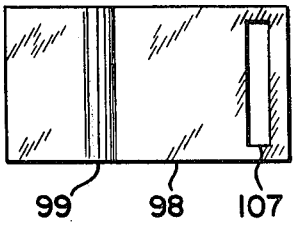
FIGS. 18–20 illustrate the preferred embodiment of the elbow latch structure of the present invention.
Figure 18:
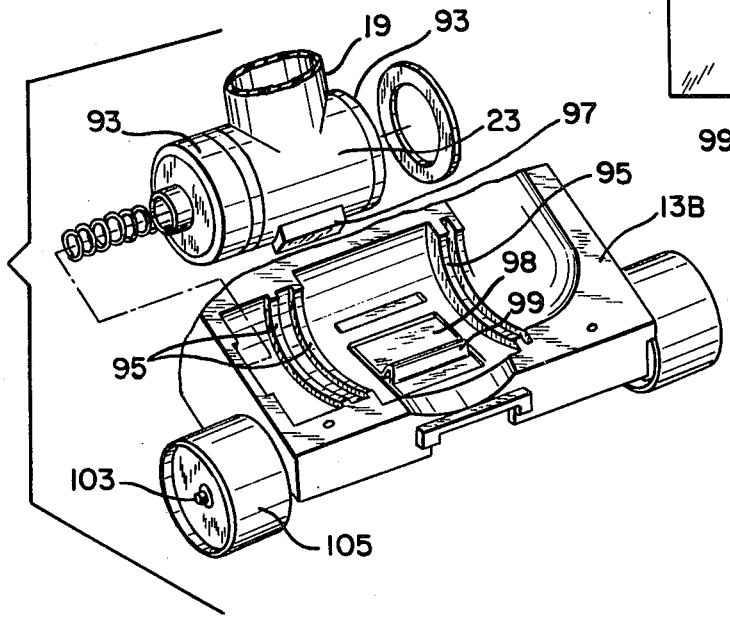

Referring to FIGS. 18–20, the vacuum cleaner coupling or elbow 23 has an extension portion 19 and a cylindrical portion 93. The cylindrical portion 93 sits in a socket 95 in the lower member 13*b* of the housing. Cylindrical portion 93 has a protrusion 97 extending therefrom and integral therewith. The protrusion 97 is formed during the molding or manufacturing of the elbow 23. Within the socket 95 is positioned a latch plate 98, which has a protrusion 99. The protrusion 99 is positioned opposite the protrusion 97 on the cylindrical portion 93. A spring 101 biases the plate 98 towards the cylindrical portion 93. The spring 101 is mounted on axle 103 of wheels 105. Plate 98 also has a slot 107 which engages a member 109 integrally formed in the housing member 13*b* so that the plate 98 can pivot about this member 109.

Figure 19A:
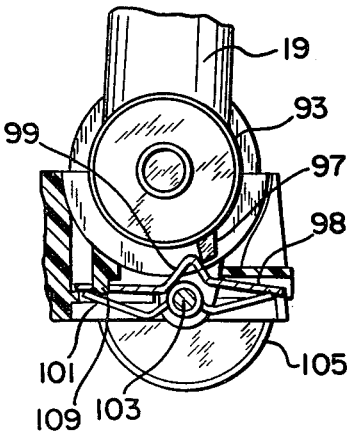
Figure 19B:
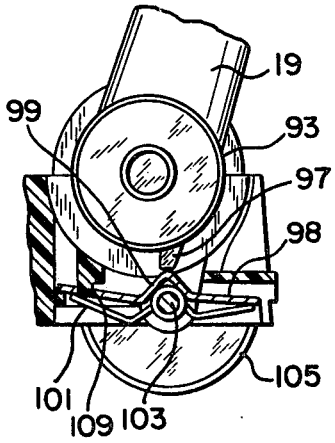

FIG. 19A illustrates the extension 19 in a substantially fixed vertical position. This position is usually used for storage when a wand is connected to the floor tool, and the floor tool and wand are stored with the wand in the vertical position. As can be seen, the protrusion 97 engages protrusion 99 and the extension 19 is held in a fixed vertical position.

Figure 19C:
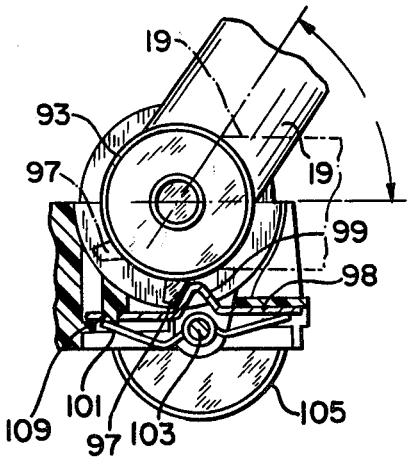

When using the floor tool, the wand is usually held in a non-vertical position. FIG. 19C illustrates the wand in its normal operating position. In this position, the protrusion 97 has been moved to the position illustrated, which allows the rotation of the cylindrical portion 93 about its axis. In going from the position illustrated in FIG. 19A to that illustrated in FIG. 19C, the latch passes through the position shown in FIG. 19B. In this position, the protrusion 97 pushes down against protrusion 99 and protrusion 99 moves downward against the force of spring 101. However, when the latch reaches the position in FIGS. 19A or 19C, the spring 101 biases the plate back up again.

The present invention may be embodied in other specific forms without departing from the spirit or essential characteristics thereof. The presently disclosed embodiments are, therefore, to be considered in all respects as being illustrative and not restrictive. The scope of this invention is intended to be indicated by the appended claims, rather than the foregoing description, and all changes which come within the meaning and range of equivalency of the claims are to be embraced therein. What is claimed:

1. A vacuum cleaner floor tool comprising:

(a) a housing;

(b) an air-powered turbine motor in said housing, said housing including a turbine chamber for said turbine motor;

(c) agitator means partially extending from said housing, said agitator means being coupled to said turbine motor and driven thereby;

(d) base plate means, removably mounted on said housing and forming a portion of a wall thereof, said agitator means extending from said housing through an opening in said base plate means wherein air passes through said opening into said turbine chamber, said base plate means including a ramp means extending from said base plate means into said housing, wherein said ramp means and a portion of said turbine chamber form a nozzle for said turbine motor.

2. A vacuum cleaner floor tool as set forth in claim 1 wherein said ramp means includes a face means for forming a portion of said nozzle.

3. A vacuum cleaner floor tool as set forth in claim 1 including manually operable retaining means for removably holding said base plate means on said housing, wherein said retaining means are in a position to permit removal of said base plate means, said base plate means can be removed from said housing, thereby providing access to the interior of said turbine chamber.

4. A vacuum cleaner floor tool as set forth in claim 3 wherein said manually operable retaining means comprises:

(a) a rod means having one end pivotally mounted in said housing; and (b) a projection means extending from said housing for engaging the other end of said rod means, wherein when said other end of said rod means is engaged by said projection means, said rod means contacts the outer surface of said base plate means, and pushes said base plate means against said housing, whereby said retaining means retains said base plate means on said housing.

5. A vacuum cleaner floor tool as set forth in claim 4 wherein said rod means contacts said base plate means across the edges of said ramp means such that the force of said retaining means on said base plate means is concentrated towards the longitudinal center thereof.

6. A vacuum cleaner floor tool as set forth in claim 1 wherein said base plate means includes a slot means, a stud means, said slot means and said stud means being positioned on a line perpendicular to the axis of said agitator means; and a spring means, wherein said slot means receives one end portion of said spring means and wherein the other end portion of said spring means is supported by said stud means, and wherein at least one end of said agitator means is supported by said spring means.

7. A vacuum cleaner floor tool as set forth in claim 6 wherein said one end portion of said spring means has a bulged portion therein for engaging the sides of said slot means, thereby holding said spring means in said slot means.

8. A vacuum cleaner floor tool as set forth in claim 1 including a bumper strip mounted on said housing and surrounding said housing for preventing contact between said housing and an object; said floor tool further including a cover means for covering said housing, said cover means having notch means therein, said notch means engaging said bumper strip and holding said bumper strip against said housing to prevent said bumper strip from separating from said housing.

9. A vacuum cleaner floor tool as set forth in claim 1 including a bumper strip mounted on said housing and surrounding said housing, said bumper strip including a lip means for contacting said base plate means and forming an air seal therewith to prevent air from entering said housing around said bumper strip means.

10. A vacuum cleaner floor tool as set forth in claim 9 further including a cover means for covering said housing, said cover means having a notch means therein, said notch means engaging, said bumper strip and holding said bumper strip against said housing to prevent said bumper strip from separating from said housing.

11. A vacuum cleaner floor tool as set forth in claim 1 including wand coupling means for coupling said turbine chamber to a vacuum cleaner wand, said wand coupling means having a first portion rotatably mounted in said housing, an extension extending from said first portion, and latch means for holding said extension in a fixed state or in a rotatable state, said latch means comprising a first protrusion extending from said first portion, and a plate member mounted in said housing, said plate member having a second protrusion thereon, said second protrusion being opposed to said first protrusion, wherein when said first protrusion is on one side of said second protrusion, said extension is in said fixed state and when said first protrusion is on the other side of said second protrusion, said extension is in said rotatable state.

12. A vacuum cleaner floor tool as set forth in claim 11 wherein said latch means includes spring means for biasing said plate member towards said first portion.

13. A vacuum cleaner floor tool as set forth in claim 12 wherein said plate member includes a slot therein and said housing includes a projection for engaging said slot such that said plate member pivots about said projection.

14. A vacuum cleaner floor tool as set forth in claims 11, 12 or 13 wherein said housing comprises a first member and a second corresponding member, said second member including said wall, said first and second members being mated to one another in a single plane to form said housing wherein said single plane is the plane formed by the axis of said turbine motor and the axis of said first portion of said wand coupling means, and wherein said single plane forms an acute angle with the plane through said wall of said second member.

15. A vacuum cleaner floor tool as set forth in claim 14 wherein said acute angle is 18°.

16. A vacuum cleaner floor tool as set forth in claim 1 wherein said agitator means comprises a rotatable cylinder having spiral grooves along the surface thereof, at least one end of said cylinder being reduced in diameter such that said spiral grooves forms substantially flat surfaces on the reduced cylindrical surface.

17. A vacuum cleaner floor tool as set forth in claim 16 including drive coupling means for coupling said turbine motor to said agitator means, said drive coupling means including connector means fitted onto said at last one end of said rotatable cylinder, said connector means having lugs corresponding to said flat surfaces on said at least one end, whereby said connector means engages said agitator means and prevents relative rotation therebetween.

18. A vacuum cleaner floor tool as set forth in any of claims 1–10, 16 or 17 including a wand coupling means mounted in said housing for coupling said turbine chamber to a vacuum cleaner wand wherein said housing comprises a first member and a corresponding second member, said second member including said wall, said first and second members being mated to one another in a single plane to form said housing wherein said single plane is the plane formed by the axis of said turbine motor and the axis of said wand coupling means, and wherein said single plane forms an acute angle with the plane through said wall of said second member.

19. A vacuum cleaner as set forth in claim 18 wherein said acute angle is 18°.

20. A vacuum cleaner floor tool comprising:

(a) a housing;

(b) an air-powered turbine motor in said housing;

(c) agitator means partially extending from said housing, said agitator means comprising an elongated member having at least one spiral groove therein extending in the longitudinal axial direction thereof, wherein at least one end portion of said elongated member is reduced in diameter such that said spiral groove thereon is reduced to a substantially flat surface, connector means mounted on said reduced portion, said connector means having lug means for engaging said substantially flat surface to prevent said elongated member for rotating relative to said connector means, and a carpet agitator fixed in spiral groove;

(d) drive coupling means coupling said agitator means and said turbine motor such that said agitator means is driven by said turbine motor, said drive coupling means engaging said connector means; and (e) base plate means removably mounted on said housing and forming a wall thereof, said agitator means extending from said housing through an opening in said base plate means wherein air is drawn through said opening into said turbine motor, said base plate means including a slot means, a stud means, said slot means and said stud means being positioned on a line perpendicular to the axis of said agitator means, and a spring means, wherein said slot means receives one end portion of said spring means and wherein the other end portion of said spring means is supported by said stud means, wherein at least one end of said agitator means is supported by said spring means.

21. A vacuum cleaner floor tool as set forth in claim 20 wherein said one end portion of said spring means has a bulged portion therein for engaging the sides of said slot means, thereby holding said spring means in said slot means.

22. A vacuum cleaner floor tool comprising:

(a) a housing;

(b) an air-powered turbine motor in said housing;

(c) agitator means partially extending from said housing, said agitator means being coupled to said turbine motor and driven thereby;

(d) base plate means removably mounted on said housing and forming a wall thereof and a joint therewith, said agitator means extending from said housing through an opening in said base plate means, said base plate means including a slot means, a stud means, said slot means and said stud means being positioned on a line perpendicular to the axis of said agitator means, and a spring means wherein said slot means receives one end portion of said spring means and wherein the other end portion of said spring means is supported by said stud means, wherein at least one end of said agitator means is supported by said spring means; and (e) a bumper strip on said housing for absorbing the impact of said floor tool against an object, said bumper strip including lip means for contacting the exterior of said base plate means and forming an air seal for said joint of said base plate means and said housing.

23. A vacuum cleaner floor tool as set forth in claim 22 wherein said one end portion of said spring means has a bulged portion therein for engaging the sides of said slot means, thereby holding said spring means in said slot means.

24. A vacuum cleaner floor tool comprising:

(a) a housing;

(b) an air-powered turbine motor in said housing, said housing including a turbine chamber for said turbine motor;

(c) agitator means partially extending from said housing, said agitator means being coupled to said turbine motor and driven thereby;

(d) base plate means, removably mounted on said housing and forming a portion of a wall thereof, said agitator means extending from said housing through an opening in said base plate means wherein air passes through said opening into said turbine chamber; and (e) a removable ramp means extending from said base plate means to said turbine chamber, wherein said ramp means forms at least a portion of a nozzle for said turbine motor, wherein removal of said ramp means permits direct access to said nozzle and turbine chamber from the exterior of said housing.

25. A vacuum cleaner floor tool as set forth in claim 24 wherein said ramp means is coupled to said base plate means.

26. A vacuum cleaner floor tool as set forth in claim 25 wherein said ramp means is integral with said base plate means.

27. A vacuum cleaner floor tool as set forth in claim 24, wherein said ramp means includes a face means for forming a portion of said nozzle.

28. A vacuum cleaner floor tool as set forth in claim 24, including manually operable retaining means for removably holding said base plate means on said housing, wherein when said retaining means are in a position to permit removal of said base plate means, said base plate means can be removed from said housing, thereby providing access to the interior of said turbine chamber.

29. A vacuum cleaner floor tool as set forth in claim 28 wherein said manually operable retaining means comprises:

(a) a rod means having one end pivotally mounted in said housing; and (b) a projection means extending from said housing for engaging the other end of said rod means, wherein when said other end of said rod means is engaged by said projection means, said rod means contacts the outer surface of said base plate means, and pushes said base plate means against said housing, whereby said retaining means retains said base plate means on said housing.

30. A vacuum cleaner floor tool as set forth in claim 29 wherein said rod means contacts said base plate means across the edges of said ramp means such that the force of said retaining means on said base plate means in concentrated towards the longitudinal center thereof.

31. A vacuum cleaner floor tool as set forth in claim 24 wherein said base plate means includes a slot means, a stud means, said slot means and said stud means being positioned on a line perpendicular to the axis of said agitator means; and a spring means, wherein said slot means receives one end portion of said spring means and wherein the other end portion of said spring means is supported by said stud means, and wherein at least one end of said agitator means is supported by said spring means.

32. A vacuum cleaner floor tool as set forth in claim 31 wherein said one end portion of said spring means has a bulged portion therein for engaging the sides of said slot means, thereby holding said spring means in said slot means.

33. A vacuum cleaner floor tool as set forth in claim 24 including a bumper strip mounted on said housing and surrounding said housing for preventing contact between said housing and an object; said floor tool further including a cover means for covering said housing, said cover means having notch therein, said notch engaging said bumper strip and holding said bumper strip against said housing to prevent said bumper strip from separating from said housing.

34. A vacuum cleaner floor tool as set forth in claim 24 including a bumper strip mounted on said housing and surrounding said housing, said bumper strip including a lip means for contacting the exterior of said base plate and forming an air seal therewith to prevent air from entering said housing around said bumper strip.

35. A vacuum cleaner floor tool as set forth in claim 34 further including a cover means for covering said housing, said cover means having a notch means therein, said notch means engaging said bumper strip and holding said bumper strip against said housing to prevent said bumper strip from separating from said housing.

36. A vacuum cleaner floor tool as set forth in claim 24 including wand coupling means for coupling said turbine chamber to a vacuum cleaner wand, said wand coupling means having a first portion rotatably mounted in said housing, an extension extending from said first portion, and latch means for holding said extension in a fixed state or in a rotatable state, said latch means comprising a first protrusion extending from said first portion, and a plate member mounted in said housing, said plate member having a second protrusion thereon, said second protrusion being opposed to said first protrusion, wherein when said first protrusion is on one side of said second protrusion, said extension is in said fixed state and when said first protrusion is on the other side of said second protrusion, said extension is in said rotatable state.

37. A vacuum cleaner floor tool as set forth in claim 36 wherein said latch means includes spring means for biasing said plate means towards said first portion.

38. A vacuum cleaner floor tool as set forth in claim 37, wherein said plate member includes a slot therein and said housing includes a projection for engaging said slot such that said plate member pivots about said projection.

39. A vacuum cleaner floor tool as set forth in claims 36, 37 or 38 wherein said housing comprises a first member and a second corresponding member, said second member including said wall, said first and second members being mated to one another in a single plane to form said housing wherein said single plane is the plane formed by the axis of said turbine motor and the axis of said first portion of said wand coupling means, and wherein said single plane forms an acute angle with the plane through said wall of said second member.

40. A vacuum cleaner floor tool as set forth in claim 39, wherein said acute angle is 18°.

41. A vacuum cleaner floor tool as set forth in claim 24 wherein said agitator means comprises a rotatable cylinder having spiral grooves along the surface thereof, at least one end of said cylinder being reduced in diameter such that said spiral grooves forms substantially flat surfaces on the reduced cylindrical surface.

42. A vacuum cleaner floor tool as set forth in claim 41 including drive coupling means for coupling said turbine motor to said agitator means, said drive coupling means including connector means fitted onto said at least one end of said rotatable cylinder, said connector means having lugs corresponding to said flat surfaces on said at least one end, whereby said connector means engages said agitator means and prevents relative rotation therebetween.

43. A vacuum cleaner floor tool as set forth in any of claims 24–35, 41 or 42 including a wand coupling means mounted in said housing for coupling said turbine chamber to a vacuum cleaner wand wherein said housing comprises a first member and a corresponding second member, said second member including said wall, said first and second members being mated to one another in a single plane to form said housing wherein said single plane is the plane formed by the axis of said turbine motor and the axis of said wand coupling means, and wherein said single plane forms an acute angle with the plane through said wall of said second member.

44. A vacuum cleaner as set forth in claim 41 wherein said acute angle is 18°.

45. A vacuum cleaner floor tool comprising:

(a) a housing having an axis about which said motor rotates having first and second corresponding members which are mated together in a single plane to form said housing;

(b) an air powered turbine motor in said housing, said housing forming a turbine chamber for said turbine motor;

(c) agitator means partially extending from said housing, said agitator means being coupled to said turbine motor and driven thereby;

(d) wand coupling means mounted in said housing for coupling said turbine chamber to a vacuum cleaner wand;

(e) base plate means mounted on said housing and forming a portion of a wall thereof, said agitator means extending from said housing through an opening in said base plate means;

(f) wherein said wand coupling means defines a rotative axis parallel to said turbine motor axis said wand coupling means axis being closer to the plane of said wall than the axis of said turbine motor, and said single plane is the plane defined by the axis of said turbine motor and the axis of said wand coupling means, and wherein said single plane forms an acute angle with the plane through said wall of said second member; and (g) manually operable retaining means for removably holding said base plate means on said housing, said retaining means including a rod means having one end pivotally mounted in said housing and a projection means extending from said housing for engaging the other end of said rod means, wherein when said other end of said rod means is engaged by said projection means, said rod means contacts the outer surface of said base plate means and pushes said base plate means against said housing, whereby said retaining means retains said base plate means on said housing.

46. A vacuum cleaner floor tool as set forth in claim 45 wherein said rod means contacts said base plate means across the edges of said ramp means such that the force of said retaining means on said base plate means is concentrated towards the longitudinal center thereof.

47. A vacuum cleaner floor tool comprising:

(a) a housing having first and second corresponding members which are mated together in a single plane to form said housing;

(b) an air powered turbine motor in said housing having an axis about which said motor rotates, said housing forming a turbine chamber for said turbine motor;

(c) agitator means partially extending from said housing, said agitator means being coupled to said turbine motor and driven thereby;

(d) wand coupling means mounted in said housing for coupling said turbine chamber to a vacuum cleaner wand;

(e) base plate means mounted on said housing and forming a portion of a wall thereof, said agitator means extending from said housing through an opening in said base plate means;

(f) wherein said wand coupling means defines a rotative axis parallel to said turbine motor axis said wand coupling means axis being closer to the plane of said wall than the axis of said turbine motor, and said single plane is the plane defined by the axis of said turbine motor and the axis of said wand coupling means, and wherein said single plane forms an acute angle with the plane through said wall of said second member; and (g) wherein said base plate means includes a slot means, a stud means, said slot means and said stud means being positioned on a line perpendicular to the axis of said agitator means; and a spring means, wherein said slot means receives one end portion of said spring means and wherein the other end portion of said spring means is supported by said stud means, and wherein at least one end of said agitator means is supported by said spring means.

48. A vacuum cleaner floor tool as set forth in claim 47 wherein said one end portion of said spring means has a bulged portion therein for engaging the sides of said slot means, thereby holding said spring means in said slot means.

49. A vacuum cleaner floor tool comprising:

(a) a housing having first and second corresponding members which are mated together in a single plane to form said housing;

(b) an air powered turbine motor in said housing having an axis about which said motor rotates, said housing forming a turbine chamber for said turbine motor;

(c) agitator means partially extending from said housing, said agitator means being coupled to said turbine motor and driven thereby;

(d) wand coupling means mounted in said housing for coupling said turbine chamber to a vacuum cleaner wand;

(e) wherein said wand coupling means has a first portion rotatably mounted in said housing, an extension from said cylindrical portion, and latch means for holding said extension in a fixed state or in a rotatable state, said latch means comprising a first protrusion extending from said first portion and a plate member mounted in said housing, said plate member having a second protrusion thereon, said second portrusion being opposed to said first protrusion wherein, when said first protrusion is on one side of said second protrusion, said extension is in said fixed state and, when said first protrusion is on the other side of the second protrusion, said extension is in said rotatable state;

(f) base plate means mounted on said housing and forming a portion of a wall thereof, said agitator means extending from said housing through an opening in said base plate means; and (g) wherein said wand coupling means defines a rotative axis parallel to said turbine motor axis said wand coupling means axis being closer to the plane of said wall then the axis of said turbine motor, and said single plane is the plane defined by the axis of said turbine motor and the axis of said wand coupling means, and wherein said single plane forms an acute angle with the plane through said wall of said second member.

50. A vacuum cleaner floor tool as set forth in claim 49 wherein said latch means includes spring means for biasing said plate member towards said first portion.

51. A vacuum cleaner floor tool as set forth in claim 50 wherein said plate member includes a slot therein and said housing includes a projection for engaging said slot such that said plate member pivots about said projection.

52. A vacuum cleaner floor tool comprising:

(a) a housing having first and second corresponding members which are mated together in a single plane to form said housing;

(b) an air powered turbine motor in said housing having an axis about which said motor rotates, said housing forming a turbine chamber for said turbine motor;

(c) agitator means partially extending from said housing;

(d) said agitator means comprising a rotatable cylinder having spiral grooves along the surface thereof, at least one end of said cylinder being reduced in diameter such that said spiral grooves form substantially flat surfaces on the reduced cylindrical surface;

(e) drive coupling means for drivingly coupling said turbine motor to said agitator means, said coupling means including connector means fitted onto said at least one end of said rotatable cylinder, said connector means having lugs corresponding to said flat surfaces on said at least one end, whereby said connector means engages said agitator means and prevents relative rotation therebetween;

(f) wand coupling means mounted in said housing for coupling said turbine chamber to a vacuum cleaner wand;

(g) base plate means mounted on said housing and forming a portion of a wall thereof, said agitator means extending from said housing through an opening in said base plate means; and (h) wherein said wand coupling means defines a rotative axis parallel to said turbine motor axis said wand coupling means axis being closer to the plane of said wall than the axis of said turbine motor, and said single plane is the plane defined by the axis of said turbine motor and the axis of said wand coupling means, and wherein said single plane forms an acute angle with the plane through the wall of said second member.

* * * * *